US011549775B1

(12) United States Patent
Chen

(10) Patent No.: US 11,549,775 B1
(45) Date of Patent: Jan. 10, 2023

(54) GUN BARREL CLEANER ROD AND CONNECTING MECHANISM THEREOF

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/875,372

(22) Filed: Jul. 27, 2022

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 35/00; F41A 29/00; B08B 9/00; B08B 2209/04; B08B 9/0436; B25H 3/021; B65D 50/04; F41C 27/00; F41C 33/00
USPC ..... 42/95; 102/442
See application file for complete search history.

(56) References Cited

U.S. PATENT DOCUMENTS 4,617,693 A * 10/1986 Meyer ..... B08B 9/045 D32/4
6,640,480 B2 * 11/2003 Williams ..... F41A 29/00 42/95
2003/0136044 A1 * 7/2003 Williams ..... F41C 23/22 42/95
2010/0275485 A1 * 11/2010 Findlay ..... F41A 35/06 42/16
2011/0119845 A1 * 5/2011 Kim ..... B08B 9/00 15/104.05
2014/0290111 A1 * 10/2014 Rogers ..... F41A 29/02 42/90
2015/0059107 A1 * 3/2015 An ..... F41A 29/00 15/93.1
2020/0271410 A1 * 8/2020 An ..... B08B 9/045

* cited by examiner

*Primary Examiner* — Michael D David

(57) ABSTRACT

A gun barrel cleaner rod includes a first cleaner rod and a second cleaner rod. The first cleaner rod and the second cleaner rod are detachably connected. A first lower end of the first cleaner rod and a second upper end of the second cleaner rod are detachably connected through a stud bolt. The stud bolt includes a first threaded end and a second threaded end. The first lower end of the first cleaner rod includes an upper thread, where the upper thread is matched with the first threaded end, and the second upper end of the second cleaner rod includes a lower thread, where the lower thread is matched with the second threaded end. The gun barrel cleaner rod achieves rapid connection through cooperation of stud bolts and a plurality of short rods, which saves storage space, transportation space, and cost.

9 Claims, 5 Drawing Sheets

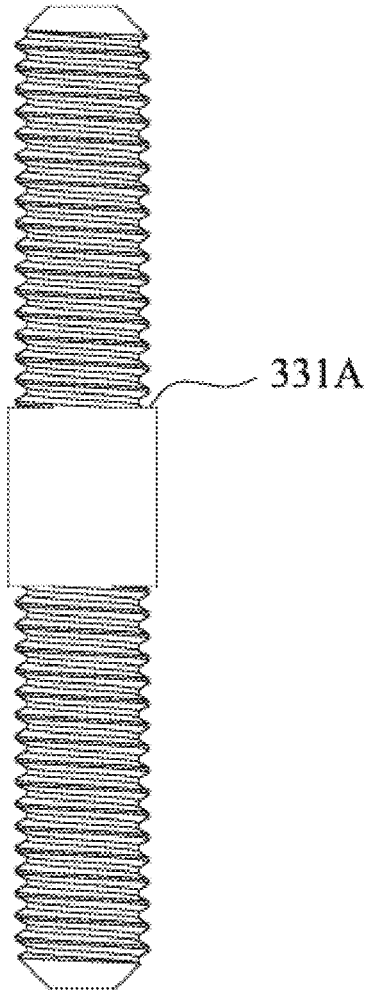
FIG. 3-A

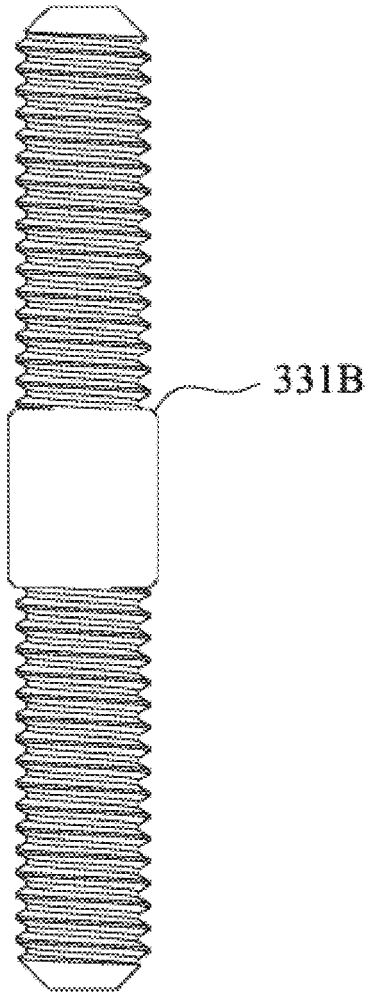
FIG. 3-B

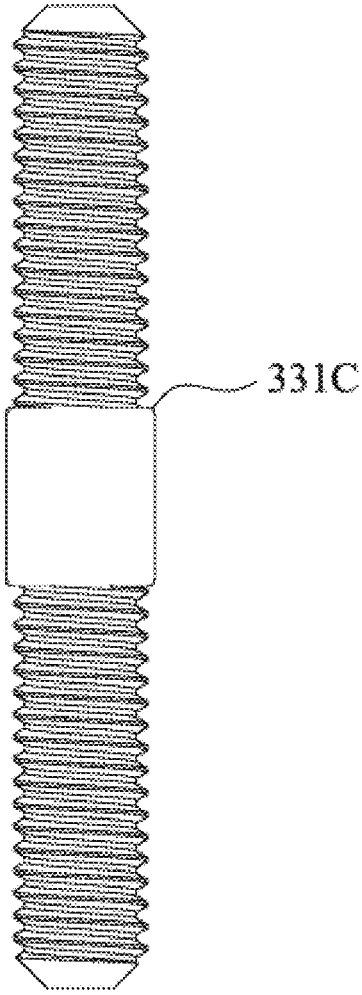
FIG. 3-C

GUN BARREL CLEANER ROD AND CONNECTING MECHANISM THEREOF

TECHNICAL FIELD

The present disclosure relates to a gun barrel cleaner rod and a connecting mechanism thereof.

BACKGROUND

A gun barrel cleaner configured to clean an interior of a gun barrel generally has a relatively long rod portion, which is suitable for the cleaning interiors of different gun barrels, especially for relatively long gun barrels. Existing gun barrel cleaner rods are of an elongated rod shape and are made of copper, diameters of the gun barrel cleaner rods are only a few millimeters, and lengths of the gun barrel cleaners rods reach hundreds or even thousands of millimeters. Thereby, gun barrel cleaner rods which are integrally formed are extremely inconvenient to store and transport, and cost of which is high, and for gun barrel cleaner rods formed through connecting a plurality of short rods, due to a fact that the gun barrel cleaner rods formed through connecting the plurality of short rods are made of copper, connecting positions of the gun barrel cleaner rod are easy to break off, and service life of which is short. Chinese Patent Pub Appl. No. CN104567539A discloses a gun barrel wiping tool, including a wiping rod, a connecting rod, and a brush head, in which a threaded connector is disposed at a connecting end of the brush head, a screw hole is defined in a top end of the wiping rod. the brush head is screwed in the screw hole of the wiping rod through the threaded connector, or the brush head is connected to the wiping rod through the connecting rod, a handle is disposed at a tail of the wiping rod. Such a threaded connection mode solves a problem of storage and transportation of gun barrel cleaner rods having a lengthened rod body. However, in actual use, due to a fact that a threaded connecting portion and the rod body of a gun barrel cleaner rod are made of copper and are integrally formed, when the gun barrel cleaner rod is used, the threaded connecting portion of the gun barrel cleaner rod are easy to break off, and once the gun barrel cleaner rod is broken off inside the gun barrel, larger inconvenience may be caused.

SUMMARY

The present disclosure aims to provide a gun barrel cleaner rod and a connecting mechanism thereof to overcome defects that a gun barrel cleaner rod in the prior art is easy to break off at connections.

Technical solutions for solving the above technical problem of the present disclosure are as follows.

A gun barrel cleaner rod includes a first cleaner rod and a second cleaner rod. The first cleaner rod and the second cleaner rod are detachably connected. A first lower end of the first cleaner rod and a second upper end of the second cleaner rod are detachably connected through a stud bolt.

Furthermore, the stud bolt includes a first threaded end and a second threaded end. The first lower end of the first cleaner rod includes an upper thread, where the upper thread is matched with the first threaded end, and the second upper end includes a lower thread, where the lower thread is matched with the second threaded end.

Furthermore, the first threaded end of the stud bolt is coaxial with the second threaded end of the stud bolt.

Furthermore, a non-threaded portion is disposed on a middle portion of the stud bolt, and the first threaded end of the stud bolt and the second threaded end of the stud bolt are coaxially connected through the non-threaded portion.

Furthermore, a first smoothing portion is disposed inside the first lower end of the first cleaner rod and near an opening of the first lower end of the first cleaner rod. A second smoothing portion is disposed inside the second upper end of the second cleaner rod and near an opening of the second upper end of the second cleaner rod. Each of the first smoothing portion and the second smoothing portion includes a smooth inner wall. The smooth inner wall of each of the first smoothing portion and the second smoothing portion are tightly fitted with an outer wall of the non-threaded portion.

Furthermore, a diameter of the non-threaded portion is greater than a diameter of the first threaded end and/or a diameter of the second threaded end.

Furthermore, a transition surface is disposed between the non-threaded portion and the first threaded end and/or the second threaded end.

Furthermore, the first threaded end is same as the second threaded end, and the first lower end of the first threaded end is same as the second upper end of the second threaded end.

The present disclosure further discloses a connecting mechanism of the gun barrel cleaner rod. The connecting mechanism of the gun barrel cleaner rod is the stud bolt of the gun barrel cleaner rod.

Furthermore, an end surface of a threaded end of the stud bolt includes an acute angle chamfer.

Compared with the prior art, the gun barrel cleaner rod has advantages that the gun barrel cleaner rod achieves rapid connection through cooperation of the stud bolts with a plurality of short rods, which saves storage space, transportation space, and cost. Strength of the stud bolt is higher than strength of a copper gun barrel cleaner rod, which solves a problem of being easy to break off at the connections of the gun barrel cleaner rod. The non-threaded portion is disposed on the stud bolt to avoid deformation or breakage caused by mutual extrusion when openings of adjacent short rods are connected.

BRIEF DESCRIPTION OF DRAWINGS

FIG. 3A is a schematic diagram of a step surface of a transition surface 331 according to one embodiment of the present disclosure.

FIG. 3B is a schematic diagram of an inclined surface of the transition surface 331 according to one embodiment of the present disclosure.

FIG. 3C is a schematic diagram of an arc surface of the transition surface 331 according to one embodiment of the present disclosure.

DETAILED DESCRIPTION

The present disclosure is described in further details below with reference to accompanying drawings.

Figure 1:
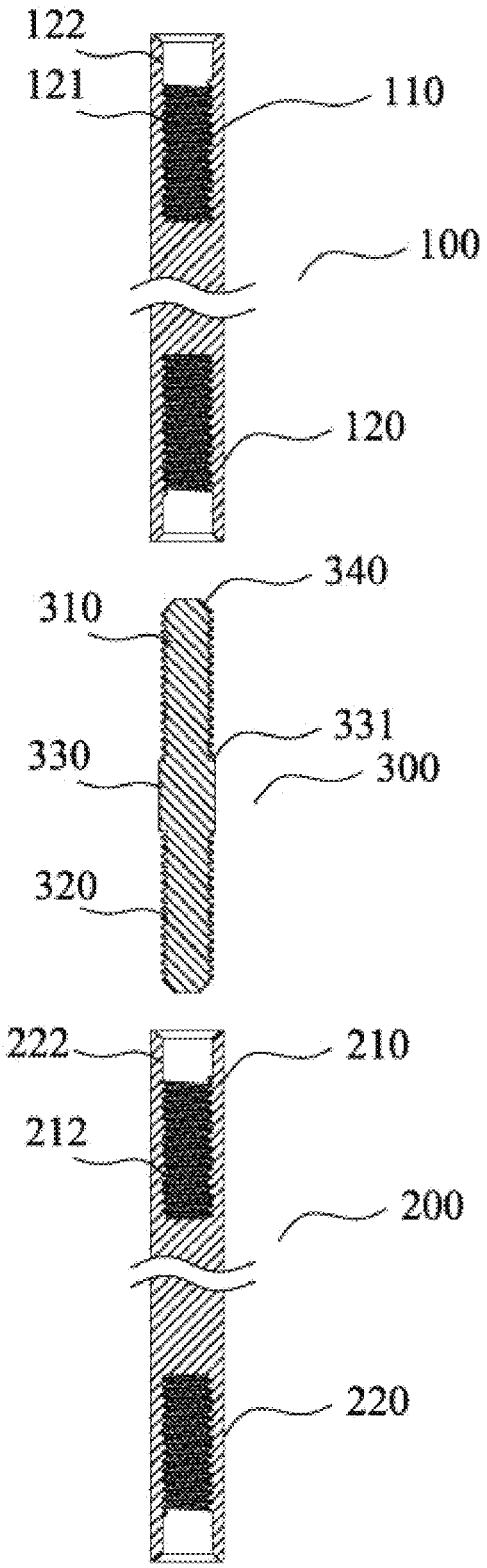
FIG. 1 is a cross-sectional schematic diagram of an exploded structure of a gun barrel cleaner rod according to one embodiment of the present disclosure.

As shown in FIG. 1, a gun barrel cleaner rod includes a first cleaner rod 100 and a second cleaner rod 200. The first cleaner rod 100 and the second cleaner rod 200 are detachably connected. A first lower end 120 of the first cleaner rod 100 and a second upper end 210 of the second cleaner rod 200 are detachably connected through a stud bolt 300.

The stud bolt 300 includes a first threaded end 310 and a second threaded end 320. The first lower end 120 of the first cleaner rod 100 includes an upper thread 121, where the upper thread 121 is matched with the first threaded end 310, and the second upper end 210 includes a lower thread 222, where the lower thread 222 is matched with the second threaded end 320.

In order to facilitate installation, each of an end surface of the first threaded end 310 and an end surface of the second threaded end 320 includes an acute angle chamfer 340, for example, a chamfer of 45°, as long as it ensures that the end surfaces of the threaded ends are easier to enter an opening of an end portion of the gun barrel cleaner rod. Correspondingly, an end surface, distal from an opening of the first lower end 120, of the upper thread 121 includes a chamfer of 45°. An end surface, distal from an opening of the second upper end 210, of the lower thread 222 of the second threaded end 210 includes a chamfer of 45°.

A non-threaded portion 330 is disposed on a middle portion of the stud bolt 300. In order to ensure that the first cleaner rod 100 and the second cleaner rod 200 are coaxial, the first threaded end 310 and the second threaded end 320 are coaxially connected through the non-threaded portion 330. Coaxial connection is very important for ensuring smoothness of a whole gun barrel cleaner rod after connection, especially the smoothness of connections. Correspondingly, a first smoothing portion 122 is disposed inside the first lower end 120 of the first threaded end 310 and near an opening of the first lower end 120 of the first threaded end 310. A second smoothing portion 212 is disposed inside the second upper end 210 of and near an opening of the second upper end 210. A smooth inner wall is respectively disposed in the first smoothing portion 122 and the second smoothing portion 212. The smooth inner wall of the first smoothing portion 122 and the smooth inner wall of the second smoothing portion 212 are tightly fitted with an outer wall of the non-threaded portion 330. That is, after the first cleaner rod 100 and the second cleaner rod 200 are connected through the stud bolt 300, the inner wall of the first smoothing portion 122 and the inner wall of the second smoothing portion 212 are both attached to the outer wall of the non-threaded portion 330. In this way, when the gun barrel cleaner rod is connected, the non-threaded portion 330 acts as a thread stopping mechanism, so that adjacent end openings are prevented from being extruded along threads to extrude each other, and deformation and even breakage caused by extrusion of the end openings are avoided.

A diameter of the non-threaded portion 330 is neither less than a diameter of the first threaded end 310 nor less than a diameter of the second threaded end 320. When the first threaded end 310 is same as the second threaded end 320, where the same herein refers to that diameters of the first threaded end 310 and the second threaded end 320 are equal, axial lengths of the first threaded end 310 and the second threaded end 320 are equal, and a screwing direction of the first threaded end 310 is same as a screwing direction of the second threaded end 320, then the first lower end 120 is same as the second upper end 210. The first cleaner rod 100 further includes a first upper end 110, and the first upper end 110 is same as the second upper end 210. The second cleaner rod 200 further includes a second lower end 220, and the second lower end 220 is same as the first lower end 120. In this way, positions of the first cleaner rod 100 and the second cleaner rod 200 may be interchanged, that is, when the first upper end 110, the first lower end 120, the second upper end 210, and the second lower end 220 are same, there is no need to distinguish cleaner rods during installation, and directly connect one end of any two of the cleaner rods with the stud bolt 300.

Certainly, when there is a requirement to distinguish each of mounting ends of the cleaner rods or each of the cleaner rods, the diameters, the axial lengths, or the screwing directions of the first threaded end 310 and the second threaded end 320 may be different. Correspondingly, the first lower end 120 is matched with the first threaded end 310, and the second upper end 210 is matched with the second threaded end 320. However, a coaxial connection still needs to be ensured between the first threaded end 310 and the second threaded end 320.

As shown in FIGS. 1, 3A, 3B, and 3C, when the diameter of the non-threaded portion 330 is greater than the diameter of the first threaded end 310 and/or the diameter of the second threaded end 320, the non-threaded portion 330 serving as a connecting portion has a higher strength. The non-threaded portion 330 is connected to the first threaded end 310 and/or the second threaded end 320 through a transition surface 331 such as a step surface 331A, an inclined surface 331B, or an arc surface 331C. Correspondingly, each of the first smoothing portion 122 and the second smoothing portion 212 further includes an inner wall tightly fitted with the transition surface 331.

When the diameter of the non-threaded portion 330 is less than the diameter of the first threaded end 310 and the diameter of the non-threaded portion 330 is less than the diameter of the second threaded end 320, a risk of breakage at the connections is increased, which belongs to a poor technical scheme.

When the diameter of the non-threaded portion 330 is equal to the diameter of the first threaded end 310 and/or the diameter of the second threaded end 320, the non-threaded portion 330 is directly connected to the threads at two ends, and the transition surface 331 is not required.

Figure 2:
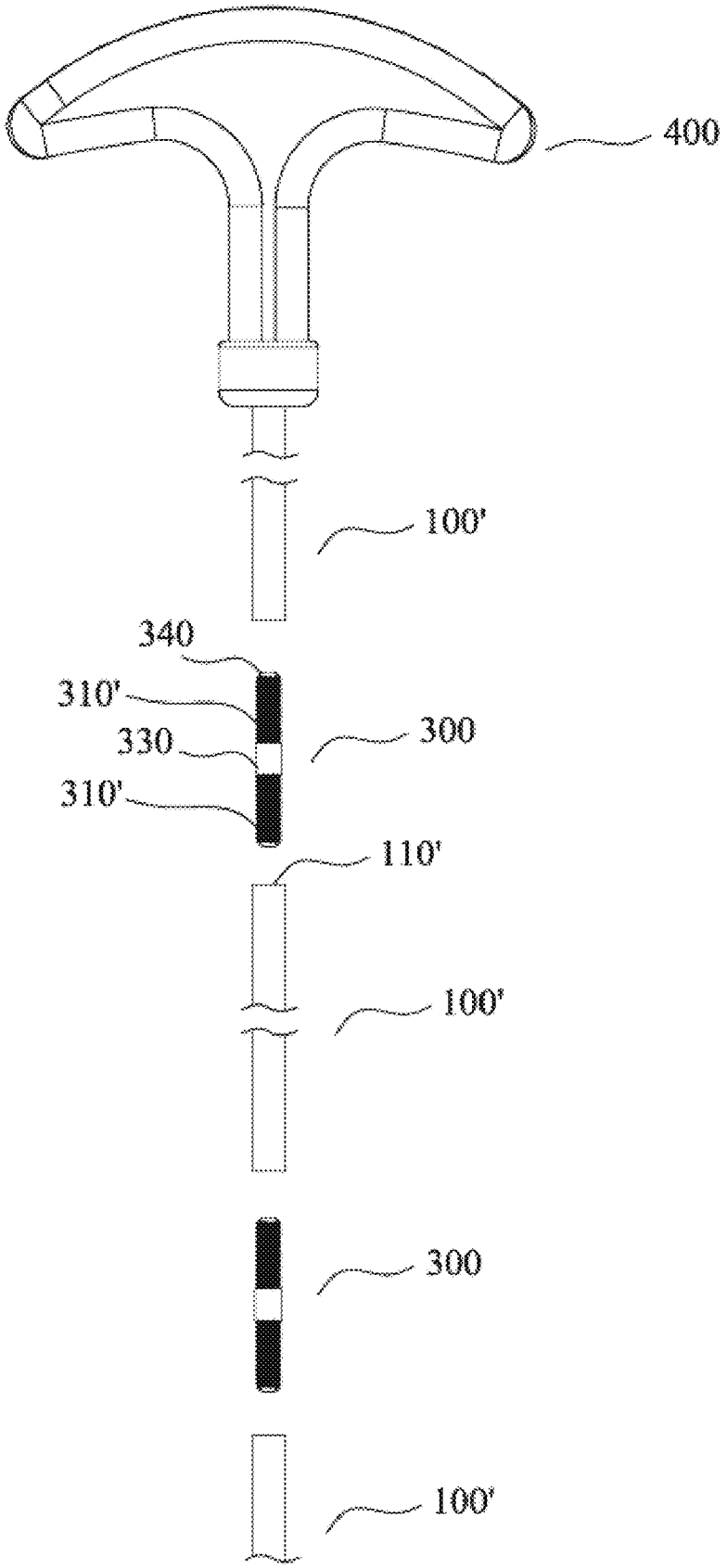
FIG. 2 is an exploded structural schematic diagram of a gun barrel cleaner rod having a handle according to one embodiment of the present disclosure.

In one embodiment, the non-threaded portion 330 is made of 304 stainless steel, and other alloys or other materials having higher hardness and rigidity may also be used. As shown in FIG. 2, the gun barrel cleaner rod of the embodiment includes three completely identical cleaner rods 100' and two completely identical stud bolts 300'. Two ends of each of the cleaner rods 100' are two identical end portions 110'. Two ends of each of the stud bolts 300' are two identical threaded ends 310', and a middle portion of each of the stud bolts 300' is the non-threaded portion 330. A diameter of each of the three cleaner rods 100' is 4 mm, and a length of each of the three cleaner rods 100' is 240 mm. A length of each of the stud bolts 300' is 18 mm, an axial length of a thread of each of the stud bolts 300' is 6.5 mm, and an axial length of the non-threaded portion 330 is 5 mm. A diameter of each of the threaded ends 310' is 3 mm, and the diameter of the non-threaded portion 330 is 3.1 mm. An axial length of a smoothing portion inside each of the cleaner rods 100 is 2.5 mm', where the smoothing portion is not shown in the drawings. In order to facilitate installation, an end surface of each of the threaded ends 310' includes a chamfer 340 of 45°, certainly, other chamfer having different acute angles are further used as long as the end surfaces of the threaded ends 310' are easier to enter openings of the end portions 110' of the cleaner rods 100'.

The gun barrel cleaner rod is detachably connected to a handle 400 of a gun barrel cleaner and brush heads having different specifications, where the brush head is not shown in the drawings. The handle 400 includes a handle bolt portion, and the brush head includes a brush head bolt portion. Both the handle bolt portion and the brush head bolt portion are same as the first threaded end 310 or the second threaded end 320. In this way, when the handle 400 and the brush head are installed, the end portions of the cleaner rods do not need to be distinguished. The handle 400 and the brush head are respectively disposed at any one end of the gun barrel cleaner rod. The gun barrel cleaner rod is further fixedly connected to the handle 400.

What is claimed is:

1. A gun barrel cleaner rod, comprising:

a first cleaner rod; and a second cleaner rod;

wherein the first cleaner rod and the second cleaner rod are detachably connected to each other; and wherein a first lower end of the first cleaner rod and a second upper end of the second cleaner rod are detachably connected through a stud bolt;

wherein the stud bolt comprises a first threaded end and a second threaded end, wherein the first lower end of the first cleaner rod comprises an upper thread, and the upper thread is matched with the first threaded end, and wherein the second upper end comprises a lower thread, and the lower thread matched with the second threaded end.

2. The gun barrel cleaner rod according to claim 1, wherein the first threaded end of the stud bolt is coaxial with the second threaded end of the stud bolt.

3. The gun barrel cleaner rod according to claim 1, wherein a non-threaded portion is disposed on a middle portion of the stud bolt, and wherein the first threaded end of the stud bolt and the second threaded end of the stud bolt are coaxially connected through the non-threaded portion.

4. The gun barrel cleaner rod according to claim 3, wherein a first smoothing portion is disposed inside the first lower end of the first cleaner rod and adjacent to an opening of the first lower end of the first cleaner rod, a second smoothing portion is disposed inside the second upper end of the second cleaner rod and adjacent to an opening of the second upper end of the second cleaner rod; each of the first smoothing portion and the second smoothing portion comprises a smooth inner wall, and the smooth inner wall of each of the first smoothing portion and the second smoothing portion is tightly fitted with an outer wall of the non-threaded portion.

5. The gun barrel cleaner rod according to claim 3, wherein a diameter of the non-threaded portion is greater than a diameter of the first threaded end and/or a diameter of the second threaded end.

6. The gun barrel cleaner rod according to claim 5, wherein a transition surface is disposed between the non-threaded portion and the first threaded end and/or the second threaded end.

7. The gun barrel cleaner rod according to claim 1, wherein the first threaded end is identical with the second threaded end, and the first lower end of the first threaded end is identical with the second upper end of the second threaded end.

8. A connecting mechanism of the gun barrel cleaner rod, the connecting mechanism of the gun barrel cleaner rod being the stud bolt of the gun barrel cleaner rod according to claim 1.

9. The connecting mechanism of the gun barrel cleaner rod according to claim 8, wherein an end surface of a threaded end of the stud bolt comprises an acute angle chamfer.

* * * * *